US006823633B2

(12) United States Patent
Ryan

(10) Patent No.: US 6,823,633 B2
(45) Date of Patent: Nov. 30, 2004

(54) SECONDARY MOISTURE DRAINAGE SYSTEM FOR STRUCTURES HAVING PRE-MANUFACTURED EXTERIOR CLADDING SYSTEMS

(75) Inventor: Michael W. Ryan, Elk Grove, CA (US)

(73) Assignee: Clark Pacific, A General Partnership, West Sacramento, CA (US)

( * ) Notice: Subject to any disclaimer, the term of this patent is extended or adjusted under 35 U.S.C. 154(b) by 125 days.

(21) Appl. No.: 10/237,403

(22) Filed: Sep. 6, 2002

(65) Prior Publication Data

US 2003/0046888 A1 Mar. 13, 2003

Related U.S. Application Data

(60) Provisional application No. 60/340,334, filed on Dec. 13, 2001, and provisional application No. 60/322,364, filed on Sep. 10, 2001.

(51) Int. Cl.[7] ..... E04B 1/70; E04F 17/00; E04F 17/04; E04F 17/08

(52) U.S. Cl. ..... 52/302.1; 52/302.3; 52/302.7; 52/3; 52/97; 52/15

(58) Field of Search ..... 52/302.1, 302.3, 52/302.7, 11, 235, 234, 97, 169.5

(56) References Cited

U.S. PATENT DOCUMENTS

| | | | | | |
|---|---|---|---|---|---|
| 3,861,419 | A | * | 1/1975 | Johnson | 137/615 |
| 3,911,954 | A | * | 10/1975 | Johnson | 137/615 |
| 4,103,598 | A | * | 8/1978 | Cooper | 454/186 |
| 4,407,097 | A | * | 10/1983 | Allen | 52/11 |
| 4,553,356 | A | * | 11/1985 | Pepper | 52/11 |
| 4,608,786 | A | * | 9/1986 | Beam | 52/16 |
| 4,807,406 | A | * | 2/1989 | Densmore | 52/11 |
| 4,912,888 | A | * | 4/1990 | Martin | 52/12 |
| 4,998,386 | A | * | 3/1991 | Baumgarth | 52/16 |
| 5,358,006 | A | * | 10/1994 | Sweers | 137/615 |
| 5,388,377 | A | * | 2/1995 | Faulkner | 52/11 |
| 5,417,015 | A | * | 5/1995 | Coyne | 52/11 |
| 5,452,743 | A | * | 9/1995 | Rortvedt | 137/615 |
| 5,522,427 | A | * | 6/1996 | Johnson | 137/616.5 |
| 5,791,091 | A | * | 8/1998 | Barbera | 52/12 |
| 5,799,445 | A | * | 9/1998 | Kock | 52/16 |
| 5,893,240 | A | * | 4/1999 | Ealer, Sr. | 52/12 |
| 6,052,959 | A | * | 4/2000 | LaBrosse | 52/302.6 |
| 6,105,323 | A | * | 8/2000 | Paulle | 52/302.1 |
| 6,240,680 | B1 | * | 6/2001 | Estes | 52/16 |
| 6,668,492 | B2 | * | 12/2003 | Warns | 52/12 |
| 2002/0152691 | A1 | * | 10/2002 | Wade | 52/11 |
| 2003/0046888 | A1 | * | 3/2003 | Ryan | 52/302.1 |
| 2003/0115807 | A1 | * | 6/2003 | Richardson | 52/11 |

* cited by examiner

*Primary Examiner*—Carl D. Friedman
*Assistant Examiner*—Nahid Amiri
(74) *Attorney, Agent, or Firm*—R. Michael West

(57) ABSTRACT

A secondary drainage system for buildings utilizing pre-manufactured exterior panels. The system drains off moisture and condensation collected in joints and on the rear wall of the panels, under circumstances where the primary exterior seal or cladding have failed. An elongated collection channel is attached in inclined relation to the rear wall of a panel. The channel includes a top cover, comprised of a trough having inclined walls and oval apertures. The lower end of the channel includes an end cap with a drain tube, connected to an upper, inner portion of a receptacle box. The receptacle box is located within a vertical joint between two adjacent panels. A lower, outer portion of the receptacle box has a one-way discharge valve. Also provided are intermediate joint gutters, having open tops and a discharge outlet positioned over the trough of a collection channel.

32 Claims, 6 Drawing Sheets

SECONDARY MOISTURE DRAINAGE SYSTEM FOR STRUCTURES HAVING PRE-MANUFACTURED EXTERIOR CLADDING SYSTEMS

CROSS-REFERENCE TO RELATED APPLICATIONS

Applicant claims the benefits under 35 U.S.C. Section 119(e) of U.S. Provisional Patent Application Ser. No. 60/322,364, filed on Sep. 10, 2001, and U.S. Provisional Patent Application Ser. No. 60/340,334, filed on Dec. 13, 2001.

BACKGROUND OF THE INVENTION

1. Field of the Invention

The invention relates generally to water drainage systems for buildings, and more particularly to a secondary water drainage system for buildings which are constructed using pre-manufactured exterior panels or cladding, such as Architectural Precast Concrete ("APC"), Glass Fiber Reinforced Concrete ("GFRC"), Composite Architectural Precast ("CAP"), or Natural Stone on a Truss Frame system ("NSTF").

2. Description of the Prior Art

Modern mid to high rise building are predominately constructed from a structural steel or cast-in-place concrete framework, upon which all other building elements are mounted and supported. For example, walls, floors, and electrical, plumbing, and HVAC systems are all integrated with and attached to the steel or concrete supporting structure. The exterior of the supporting structure is typically covered with the above-referenced pre-manufactured panels or cladding. Other common exterior coverings include glass, curtain wall systems, metal panels, stucco, Exterior Insulation Finish Systems ("EIFS"), plaster, and brick. All such exterior coverings must be carefully designed, constructed, and installed to comply with existing building specifications respecting air and water infiltration.

Exterior panels and cladding, being of a discrete size, have vertical and horizontal joints between adjacent panels. These joints must be sealed against air and water infiltration. For that purpose, high performance elastomeric sealants have been developed. The term elastomeric refers to a material's ability to compress or elongate when a stress is applied, and return to its original state when the stress is removed. These elastomeric properties are necessary to accommodate joint movements resulting from thermal expansion and contraction, inter-story building drift owing to wind forces or seismic movement, or elastic frame shortening and creep. State of the art elastomeric sealants exhibit high tolerance to joint movement, being able to accommodate movements on the order of plus or minus 25% of the joint's transverse dimension.

Silicone-based elastomeric sealants are commonly used to protect exterior panel or cladding joints from water intrusion. The manner of installation of the sealant is straightforward, but certain precautions must observed. The sealant is typically installed over a backer rod, made of polyurethane or polyethylene foam. The backer rod is initially installed along the full extent of the joint between the panels. Then, the silicone sealant is applied into the joint, against the side edges of the panels and the backer rod. The backer rod supports the sealant until it has fully sealed, and also ensures that a proper joint configuration is formed which will allow the sealant to expand and contract as required. The combination of the exterior cladding with the silicone sealant in the joints, forms the primary waterproofing barrier for the building.

The quality of this primary waterproofing barrier is highly dependent upon the skilled workmanship of the installer. For example, the installer must properly detail the bond line of the joint, by cleaning the opposing side edges of the adjacent panels so the sealant will properly adhere to the panel. The location and depth of the backer rod must be correct, to ensure that the sealant joint will have sufficient flexibility and resiliency to withstand expansion, contraction, and flexure forces. The integrity of the waterproofing barrier is also contingent upon the consistency, quality, and selection of the particular sealant used. The sealant which is most appropriate in an architectural precast concrete panel-to-panel joint, for example, may not be the proper sealant for an architectural precast concrete panel to an aluminum window mullion joint.

A failure of the waterproofing barrier can also occur when the exterior panels themselves are cracked or damaged, allowing water to pass directly through the panels. Failures in the barrier may occur at the interface between the glass and the curtain wall systems. The passage of time, including deterioration of materials, extreme temperatures, exposure to the sun, and seismic events, may all contribute to a joint failure or some other compromise in the integrity of the waterproofing barrier. Unfortunately, failure or compromise of the primary waterproofing barrier can occur with little or no warning, causing water or air intrusion.

When water leaks do occur, the damage caused to the building can further be amplified by percolation. Percolation arises when sustained high winds, or a positive external pressure caused by the operation of the building's HVAC, can literally vacuum water through the damaged sealant joints or cracked cladding. The water then bubbles or percolates into the building, causing more damage.

Another source of concern derives from condensation on the rear or backside of the panels. Sealants in the joints protect the interior region of the panels from leaks, but do nothing to protect against condensation. Under certain atmospheric conditions, water can condense on the backside of the panels even where no joint leak or panel cracking has occurred. The occurrence and extent of such condensation varies with the geographical location of the building, the type or lack of a vapor barrier, and the amount and temperature of the air infiltration into the building. When these factors favor the formation of condensation, the airspace between the panels and the supporting structure reaches 100% relative humidity. As the panels cool, condensation forms on their backsides.

Buildings also contain varying amounts of incidental moisture, resulting from small amounts of moisture which transmigrate through the panels or cladding. This occurs as a consequence of undetectable imperfections in material and workmanship. Most of the time, the leaks or condensation which produce this incidental moisture are so insignificant that the incidental moisture is absorbed by the substrate of the panels, and dries prior to any damage occurring. However, if the incidental moisture content exceeds the threshold saturation capacity of the substrate, the excess moisture may lead to interior damage to the building and promote mold growth.

The prior art teaches a number of different backup or secondary drainage systems to remove water or condensation from the rear side of exterior panels or cladding for modern buildings. For example, in Rizza, U.S. Pat. No.

5,289,664, a back drainage system for exterior panels is disclosed. An open gutter extends along the back wall of a panel, and includes a weep tube at one end extending toward the front wall of the panel. A piece of reticulated foam within the weep tube is claimed to allow water to flow out, while preventing moisture backup through the tube and wind noise. In U.S. Pat. No. 4,924,647, granted to Drucker, an exterior wall panel drainage system is shown. Gutters collect water from the rear wall, and drain tubes and weep holes drain the collected condensation to the outside of the panel wall. U.S. Pat. No. 6,216,406, issued to Smith, shows a mounting and draining system for prefabricated building panels. A drain tube extends between an interior gutter and the exterior of the panel. U.S. Pat. No. 5,048,254, granted to Merlau, shows a tapered base plate for collecting water trapped behind the building panel. The water in channeled through drainage holes into weep holes, and thereafter passes outside the building panel.

It is evident from the foregoing prior art that the industry recognizes the problems associated with rear panel condensation and water intrusion resulting from a failure of the primary waterproofing barrier. However, there is considerable room for improvement in the secondary drainage systems developed thus far. For example, percolation back through the drainage lines or weep holes of the prior art drainage systems, is a persistent problem. Prior art systems lack physical and installation flexibility, making them difficult to adapt to a variety of different panel and cladding designs. Power tools are required for the on-site installation of most prior art drainage systems. The known prior art drainage systems have no protection against debris clogging, either during the construction phase of the building or after construction is complete.

SUMMARY OF THE INVENTION

The secondary moisture drainage system of the present invention includes one or more elongated collection channels, adhesively or mechanically affixed to the rear wall of a building panel. To encourage positive drainage, the collection channels are maintained in inclined relation, extending from an upper end to a lower drain end. The channels are manufactured from flame retardant, elastomeric silicone, sufficiently flexible to follow the undulations and imperfections in the panels. Each collection channel includes opposing vertical side walls, a bottom floor spanning the side walls, and a perforated top cover. The top cover is effective to keep potentially clogging debris out of the channel. The perforations are preferably oval in configuration, to inhibit capillary action which would otherwise slow drainage through the top cover.

The lower end of each collection channel is fitted with an end cap. The end cap is constructed similarly to the collection channel, but includes a closed wall at one end, and a drain aperture and a drain spout passing water through its bottom floor. The end cap is located adjacent a vertical joint, such as would exist between two panels.

A water receptacle box is provided in each such panel joint. The upper rear portion of the receptacle box is provided with one or more inlet fittings. A drain tube interconnects the drain spout extending from the end cap with an inlet fitting, so that any moisture entering the collection channel will be directed into the receptacle box. The receptacle box is also preferably provided with an open top, to collect water or condensation draining downwardly through the panel joint.

The lower front portion of the receptacle box has a discharge fitting, provided with a one-way discharge valve. A backer rod extends through the full extent of the panel joint, generally above and below the receptacle box. The silicone sealant is injected into the joint, filling the joint between the panels while being supported both by the backer rod and by the front wall of the receptacle box. The one-way discharge valve extends forwardly, completely through the exposed side of the sealant, so that any moisture passing therethrough will be discharged outside upon the front wall of the panel. The one-way valve allows water to discharge to the exterior of the building but prevents percolation into the secondary drainage system and the interior walls of the panels.

A joint gutter may be placed into intermediate panel joints, not provided with a water receptacle box. The joint gutter includes an open top for collection of moisture dripping downwardly through the panel joint. One embodiment of the joint gutter, adapted for panel joints of larger dimensions, has vertical walls, a floor, and a discharge spout centered over the collection channel. Another embodiment of the joint gutter, adapted for more narrow panel joints, is shaped like a curved trough. Since it is made from a resilient material, it is installed by simply squeezing the gutter and inserting it into the joint. Upon release, with its lower discharge end centered over the collection channel. The joint gutter is ready to be silicone sealed into place. Both embodiments of the joint gutter collect excess moisture within the joint, and direct it into the collection channel for eventual discharge outside the building.

It is an object, therefore, of the present invention to provide a secondary drainage system, for buildings employing pre-manufactured panels, which could be field or plant installed, without the use of power tools and with minimal impact on current operations of panel manufacturers.

It is also an object of the present invention to provide such a secondary drainage system manufactured from materials which are non-combustible, compatible with exterior silicone sealants, and non-conducive to mold growth.

It is a further object herein to provide a secondary drainage system which exhibits elastomeric properties to accommodate panel irregularities and joint movements, and which provides water drainage protection for both horizontal and vertical joints between panels.

It is yet another object herein to provide a secondary drainage system which is easy to keep clean and free from construction debris during installation, and provides further safeguards to maintain such performance during the extent of its useful lifetime.

These and other objects of the present invention will be disclosed further in the drawings and in the detailed description of the preferred embodiment, to follow.

DETAILED DESCRIPTION OF THE PREFERRED EMBODIMENT

Figure 1:
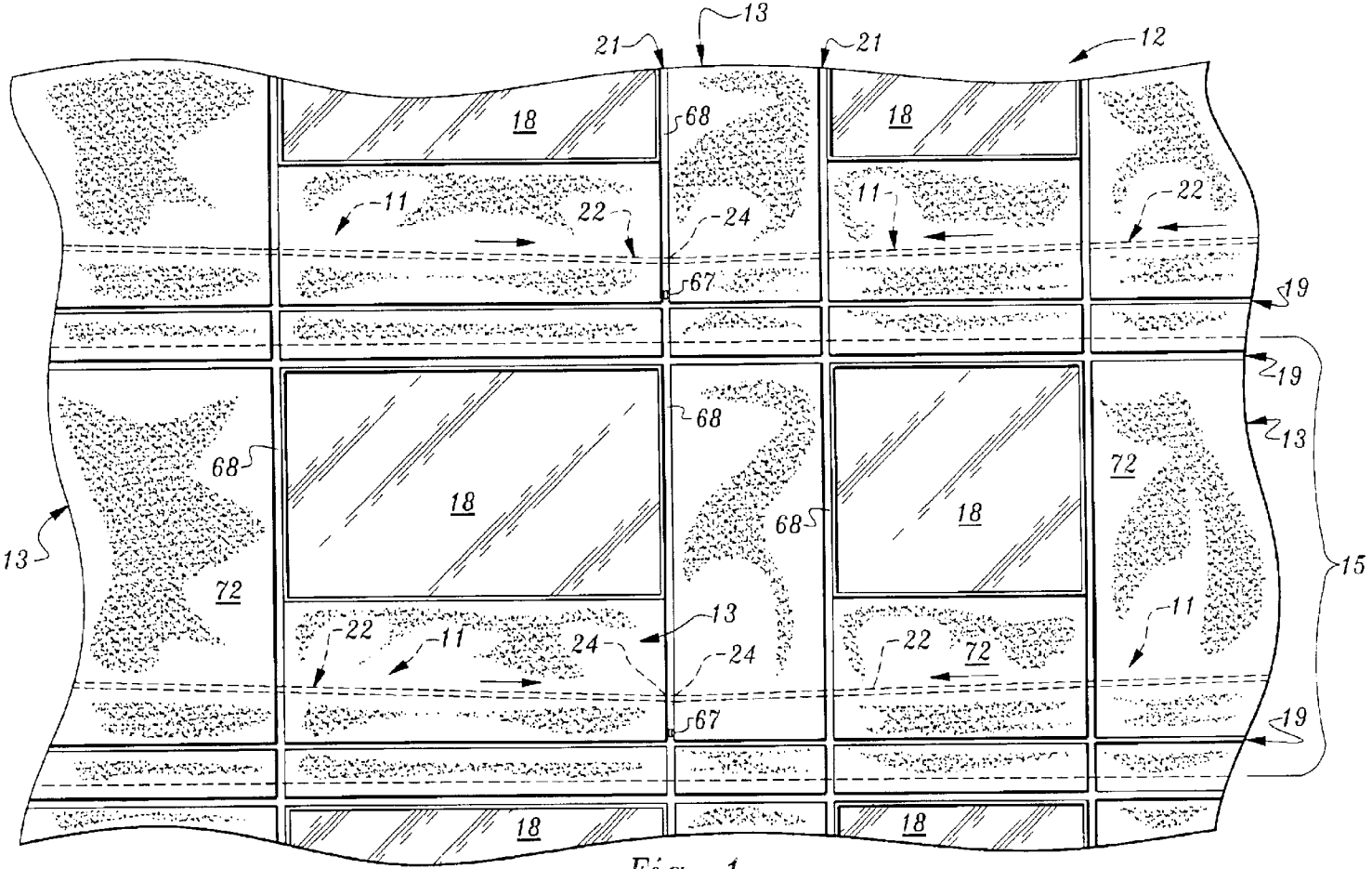
FIG. 1 is a fragmentary, front elevational view of the exterior of a building employing a plurality of exterior panels, the collection channels and the floor levels being shown in broken line.
Figure 4:
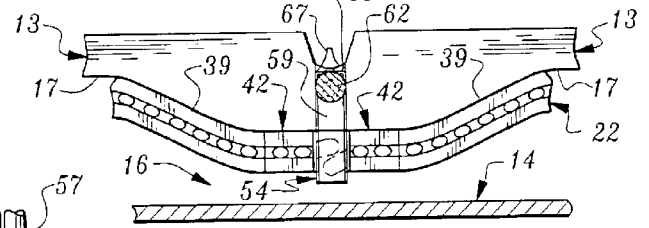
FIG. 4 is a fragmentary, top plan view of a pair of collection channels and a receptacle box.
Figure 5:
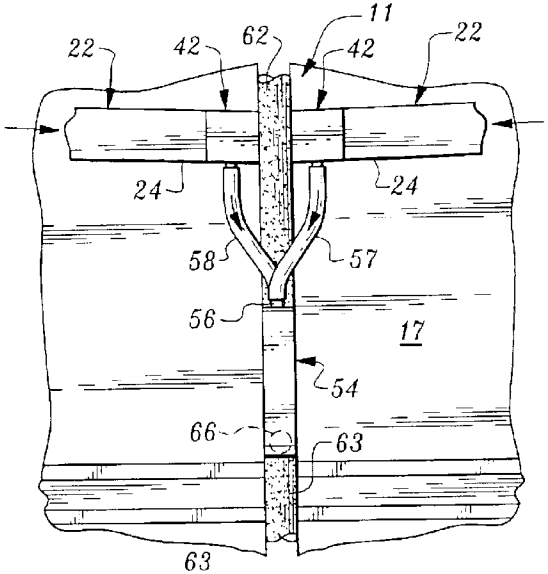
FIG. 5 is a fragmentary, rear elevational view of the same arrangement shown in FIG. 4.

Turning now to the drawings, and in particular FIG. 1, the secondary moisture draining system 11 of the present invention is designed to be used in conjunction with a mid to high-rise building 12. Such buildings are modernly constructed using a plurality of exterior panels 13, suspended in horizontally spaced relation from the building's outer support structure 14. As shown in FIG. 4, this establishes a dead space 16 between the rear wall 17 of each panel, and the building's outer support structure 14.

The panels 13 are typically pre-manufactured at facility some distance from the building site, and are transported to the site as the construction of the building progresses. As shown in FIG. 1, panels 13 assume a variety of sizes and configurations and they are arranged horizontally and vertically to define the different floors 15 of the building. Windows 18 are interspersed throughout the panels, to correspond to openings in the building's outer support structure. Horizontal joints 19 and vertical joints 21, are located between adjacent panels and between panels and windows. The moisture drainage system 11 of the present invention is integrated particularly with the building's vertical joints 21, in which certain important structures of the drainage system are located, and in some cases, through which these structures pass to the exterior of the building.

The system 11 includes one or more elongated collection channels 22, each one secured to the rear wall 17 of one or more panels 13. Each collection channel 22 is mounted in inclined relation, having an upper end 23 sloping downwardly to a lower end 24. A minimum slope of ¼" per foot of collection channel is recommended to ensure that water will move relatively quickly through the channels and the rest of the system. The collection channels are located as close to the floor as possible, to provide maximum protection while maintaining the desirable slope.

Over long spans of panels 13, successive arrangements of two collection channels 22 may be used to cover the rear walls 17, with respective upper ends 23 and respective lower ends 24, being located in adjacent relation. Alternatively, collection channels 22 may be end to end connected for longer runs of multiple collection channels. Both arrangements will be discussed in more detail herein.

Each collection channel 22 includes opposing, vertical side walls 26, a bottom floor 27 spanning the lower ends of the side walls, and a top cover, generally designated by the numeral 28. Top cover 28 comprises a trough, having inclined side walls 29 converging inwardly and downwardly toward a bottom channel 31. Top cover 28 is at least partially open for the passage of water therethrough. For that purpose, a plurality of apertures 32 is provided in a line, extending along the center of bottom channel 31. These apertures are preferably oval in configuration, to inhibit the capillary action which circular apertures exhibit. On the other hand, the apertures are relatively small and the remainder of top cover 28 is solid. Both features protect collection channel 22 from potentially clogging debris once the drainage system is installed.

Figure 2:
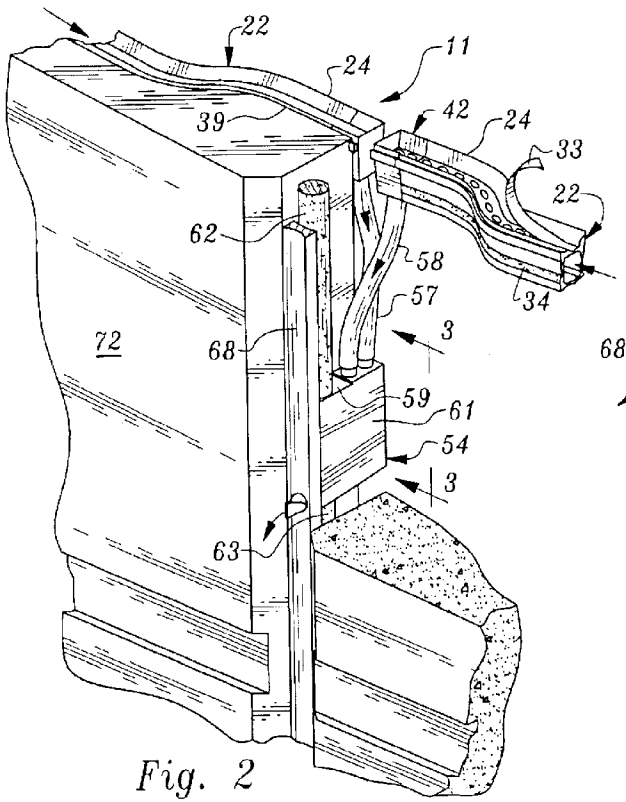
FIG. 2 is a fragmentary, right-front perspective view of a two panel joint, showing two collection channels, two drain tubes, and a receptacle box.
Figure 8:
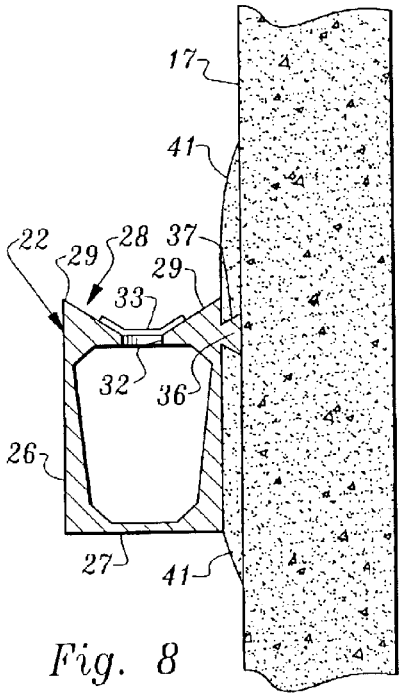
FIG. 8 is a fragmentary, cross-sectional view of a collection channel and a panel, showing the dove-tail, attachment arrangement between the two.
Figure 7:
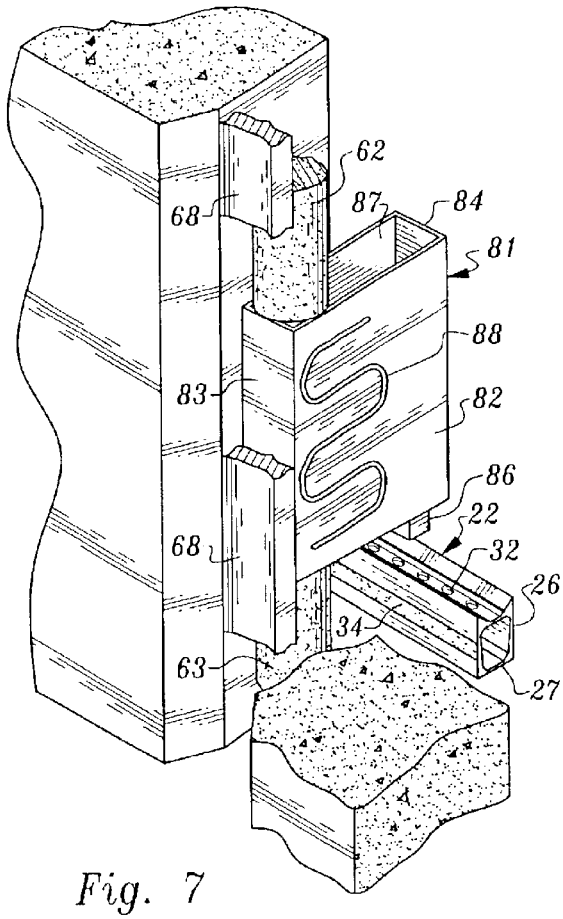
FIG. 7 is a fragmentary, left-front perspective view of a collection channel and an alternative embodiment of a joint gutter, taken from the front side of two panels.
Figure 10:
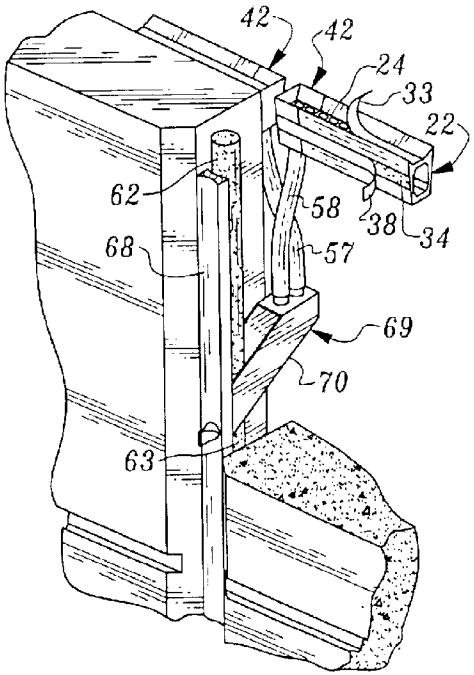
FIG. 10 is fragmentary, right-front perspective view of a two panel joint, showing two collection channels, two drain tubes, and an alternative, elongated construction for a receptacle box.

The drainage system can be clogged from construction debris, as well. To prevent such clogging, a protective, removable strip 33 is provided. (see, FIG. 8). Strip 33 is preferably made of plastic material, including a silicone compatible adhesive on its underside. In this manner, it can easily and quickly be removed after the collection channels 22 have been installed on the rear wall 17 of panel 13. This is done just before the drywall is installed on the building. FIGS. 2 and 10 show how the strip 33 is peeled away to expose the apertures 32.

Installation of the collection channels 22 may be made at the factory where the panels 13 are fabricated, or after the panels have been placed on and attached to the building, as described above. Two methods of channel attachment are disclosed herein, one employing an adhesive coating 34 in combination with silicone sealant, and the other using a mechanical interconnection between dovetail flange 36 and a dovetail channel 37. The latter method is employed only with the Glass Fiber Reinforced Concrete.

As to the first method, adhesive coating 34 is applied on the outside of the side wall 26 which is designated to be placed against rear wall 17. A removable protective strip 38 is then press-applied over coating 34 to prevent fouling of the coating before installation. (see, FIG. 10). A guide line is scribed on rear wall 17, taking into consideration the proper inclination for channel 22. Then, removing protective strip 38, the channel 22 is pressed into contingent relation against the rear wall 17, following any undulations or imperfections which that wall may have. A bead of silicone sealant 40 is applied on the interface between the rear wall 17 and contingent side wall 26, and then smoothed to provide a low resistance surface for water to flow. Adhesive coating 34 secures collection channel 24 in place, while the silicone sealant 40 is curing.

It should be noted that collection channels 22, as well as most of the remaining components of the system to be described herein, are made from a flexible, flame retardant elastomeric silicone. Retardants to inhibit mold growth may also be added to the silicone composition used to form the collection channel and other parts used herein. The flexibility of the collection channel ensures quick and easy installation over rear wall 17, even where the wall includes substantial curves in its configuration. For example, the panel 13 shown in FIG. 4 includes a substantial thickened portion and a curve region 39, adjacent the vertical joint 21 between the two panels. Collection channel 22 is easily bent into the appropriate shape, so that the adhesive coating 34 will fully contact and adhere to rear wall 17.

Figure 20:
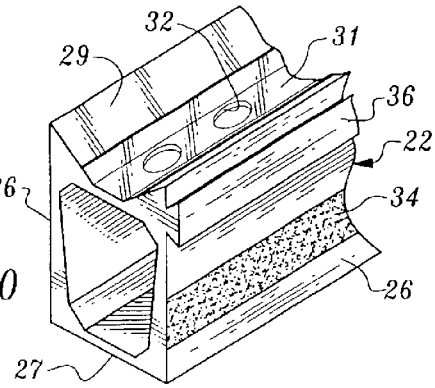

The other method for attaching collection channel 22 requires that a dovetail flange 36 be molded onto the upper portion of side wall 26. (see, FIGS. 8 and 20). This method also requires that a dovetail channel 37 be formed around flange 36, by trowling a strip of mortar slurry 41 upon rear wall 17. When the mortar slurry hardens, the collection channel is permanently affixed to rear wall 17. The gradually curving configuration of the upper part of the mortar strip ensures that water and other condensation traveling down wall 17 will be directed into the bottom channel 31.

Figure 16:
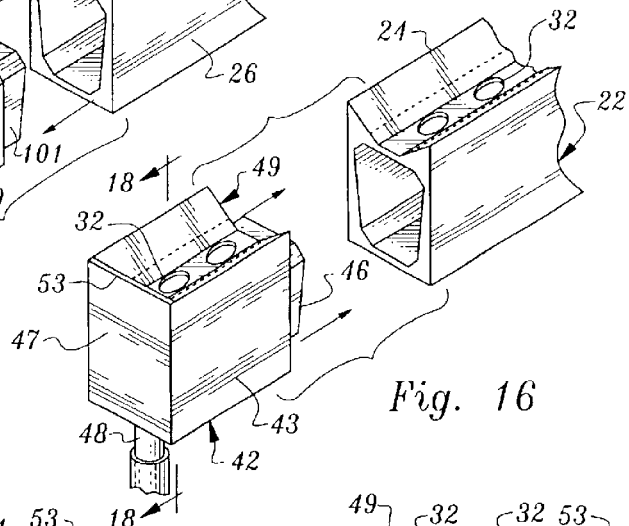
FIG. 16 is a left-front, exploded perspective view of a lower end of a collection channel and an end cap.
Figure 17:
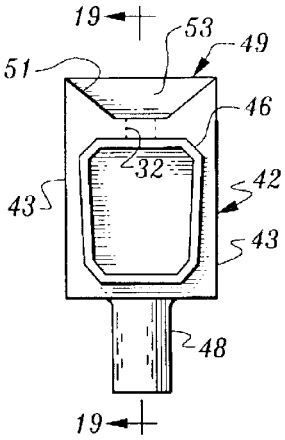
FIG. 17 is an elevational view of the coupling end of an end cap.
Figure 18:
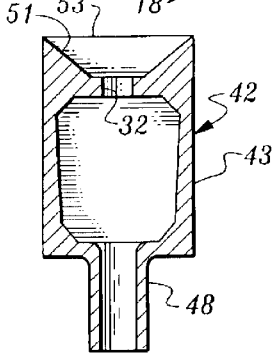
FIG. 18 is a cross-sectional view taken on the line 18—18 in FIG. 16.
Figure 19:
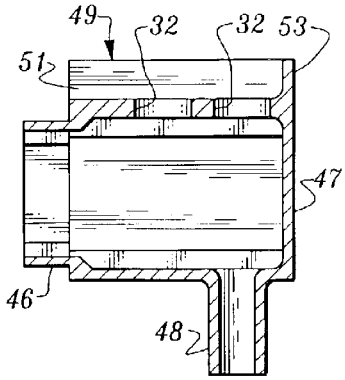
FIG. 19 is a cross-sectional view taken on the line 19—19 in FIG. 17; and, FIG. 20 is a left-front perspective of an end of a collection channel, showing the alternative, dove-tail means of attachment.

The lower end 24 of collection channel 22 is terminated in a channel end cap 42. (see, FIGS. 16–19). In many ways, the shape and features of end cap 42 mimic those of channel 22. Thus, end cap 42 has side walls 43, and a bottom floor spanning the side walls. End cap 42 further includes a connection flange 46 on one end and an end wall 47 on the other end. As shown in FIG. 16, connection flange 46 is sized and configured to compression fit within the adjacent end of collection channel 22. Before installation of the end cap 42, a light coating of silicone sealant is applied onto the outer surface of connection 46 to ensure a good seal and a permanent bond with the end of collection channel 22.

End wall 47 seals off the other end of end cap 42, providing a termination for collection channel 22. End cap 42 further includes a drain spout 48 which penetrates its bottom floor, allowing water collected therein to pass downwardly through spout 48. End cap 42 also has a top cover 49, with downwardly converging side walls 51 and a bottom channel 52. A pair of apertures 32, identical to those previously described, provides perforations for passage of water downwardly through channel 51. The upper end of end wall 47 includes an end dam 53, which prevents collected water from passing further along bottom channel 52. In this manner, all moisture entering both top cover 29 and top cover 49 eventually makes its way into drain spout 48.

A water receptacle box 54 is provided for installation within vertical joint 21. Receptacle box 54 is preferably made from the same flame retardant, elastomeric silicone material as collection channels 22. Receptacle box 54 has three distinct functions. First, box 54 functions to consolidate collected water from multiple collection channels. Second, box 54 collects water dripping downwardly through vertical joint 21 between adjacent panels. Third, box 54 safely discharges all of the consolidated and collected water exteriorly, through the primary waterproofing seal of the building to the surrounding environment.

To that end, receptacle box 54 includes inlet fittings 56, on its upper, rear portion. A first drain tube 57 and a second drain tube 58 interconnect a respective drain spout 48 with a respective inlet fitting 56 on the receptacle box. This places the rear portion of the receptacle box in hydraulic communication with the lower ends of collection channels 22. This also accomplishes the first function of the receptacle box, namely, consolidating water which has been intercepted by the two collection channels 22.

Figure 11:
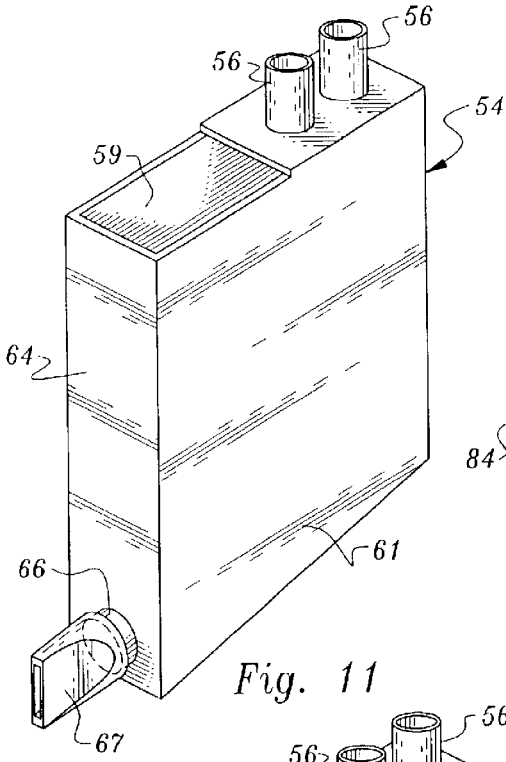
FIG. 11 is a left-front perspective view of a receptacle box including a one-way pinch valve.

Receptacle box 54 further includes a top opening 59. (see, FIG. 11). The purpose of top opening 59 is to intercept and collect any moisture dripping through the interior portion of vertical joint 21. Moisture which is so received enters the contained volume defined by box 54, and joins any other moisture incoming from the collection channels.

Silicone adhesive (not shown) is typically applied to side walls 61 of receptacle box 54, before it is installed into the vertical joint 21. A smoothed bead of silicone sealant is also placed around the sides of top opening 59, where they touch the joint edges of the panels. In that manner, the receptacle box will be maintained securely in place, and water and condensation will be encouraged to enter the receptacle box.

Following installation of the receptacle box, the primary waterproofing seal in the vertical joint 21 is then formed. The backer rod is installed in two pieces, an upper section 62 and a lower section 63. A lowermost end of upper section 62 of the backer rod may enter the top opening 59 of the receptacle box 54. And, the uppermost end of lower section 63 should fit in snug relation with the bottom of receptacle box 54. In that fashion, a substantially continuous seal backing exists, formed by the combination of upper section 62, lower section 63, and the front wall 64 of receptacle box 54.

Extending from the lower end of front wall 64 is a short extension tube 66 with a one-way discharge valve 67 fitted thereon. Discharge valve 67 embodies a simple "pinch" design, allowing water to pass outwardly when hydrostatic pressures within receptacle box 54 are sufficient to overcome resilient forces within the pinched down restrictive outlet. However, owing to this same design, water and wind are unable to enter into the restrictive outlet of valve 67, so that water percolation and wind noise are inhibited. Valve 67 is simply attached to tube 66 using silicone sealant, so it may be removed for examination or replacement as necessary. Alternatively, discharge valve 67 may be integrally molded with the rest of receptacle box 54.

Figure 3:
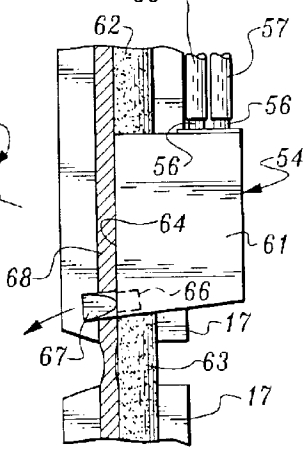
FIG. 3 is a cross-sectional view, taken on the line 3—3 in FIG. 2, showing how the upper and lower sections of the backer rod, the receptacle box, and the silicone sealant form the primary weatherproofing seal.

The primary waterproofing seal is now formed by injecting silicone sealant 68 into vertical joint 21. As shown particularly in FIGS. 2, 3, and 4, the silicone sealant is injected against the outwardly facing portions of the backer rod sections 62 and 63, and against front wall 64 of receptacle box 54. It should be noted that discharge valve 67 extends exteriorly from the outer surface of the silicone sealant, ensuring the ability of the drainage system 11 to dispel collected water to the exterior of the building. The outer surface of the silicone sealant 68 is smoothed into a generally U-shaped configuration. A seal formed in this fashion has proven effective in withstanding substantial movement of the building panels without failure.

Figure 13:
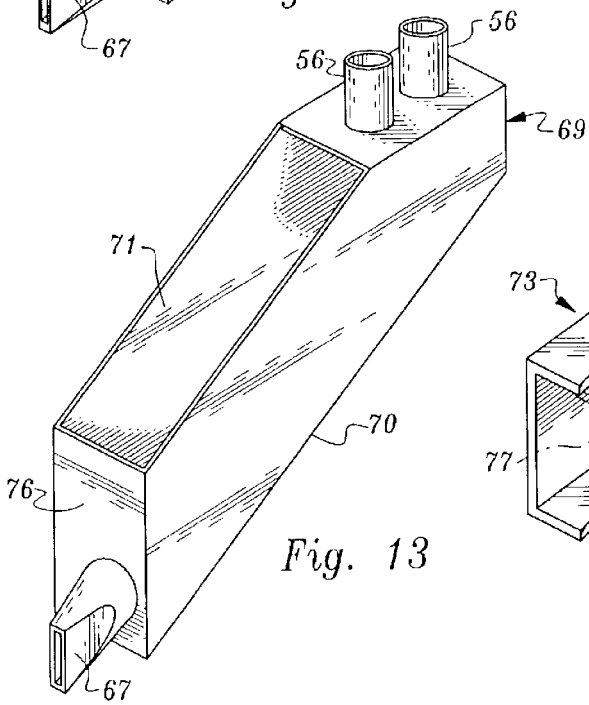
FIG. 13 is a left-front perspective view of the receptacle box shown in FIG. 10.

In FIGS. 10 and 13, an alternative embodiment of a receptacle box is shown. Receptacle box 69 is substantially similar in its features to receptacle box 54, including an inclined floor 70 to ensure positive drainage. However, receptacle box 69 is shallower and more elongated than box 54, and includes a longer top opening 71. Receptacle box 69 is used in circumstances where the panel joint is thicker than normal, requiring a greater longitudinal dimension to collect water from the rear of the panels and transfer it exteriorly, to the front walls 72 of the panels 13. This arises primarily in building constructions using panels manufactured from architectural precast concrete.

Figure 14:
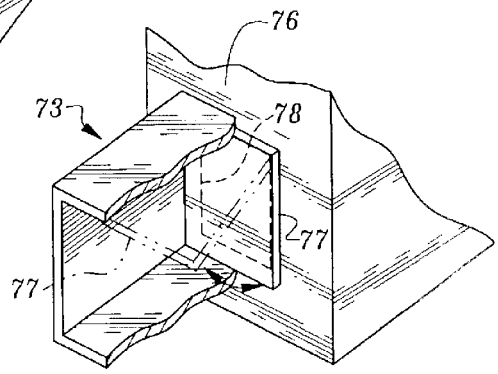
FIG. 14 is a left-front perspective view an alternative one-way flap valve, used at the discharge of a receptacle box.

FIG. 14 shows an alternative embodiment of a one-way discharge valve 73, to be used in conjunction with either receptacle box 54 or receptacle box 6. Valve 73 includes a piece of square tubing 74 extending from front wall 76. A square flap valve 77 is suspended along its upper horizontal edge over a square aperture 78 in the front wall 76. Flap valve 77 is sized slightly larger than aperture 78, and is slightly resiliently biased into a closed position, as shown in full line in FIG. 14. Tubing 74 provides a sheltered enclosure for valve 77, preventing cross winds from opening the valve, and also inhibiting the entry of dirt and other fouling agents into the valve seat. Valve 77 remains closed until hydrostatic pressure from water in the receptacle box creates enough pressure to pivot valve 77 into an open position, releasing the water outside the building. This open position for valve 77 is shown in broken line in FIG. 14. When pressures on the outside of the valve increase relative to pressures within receptacle box, the valve is simply urged to a closed position. This one-way valve therefore inhibits intrusive water percolation and wind noise in a similar fashion as discharge valve 67.

Figure 12:
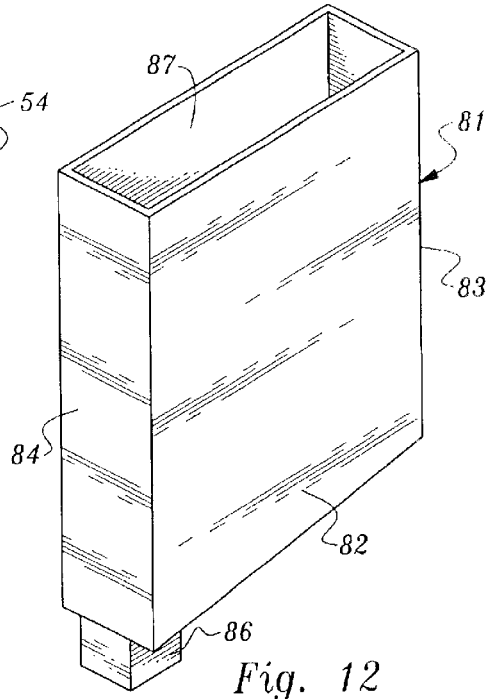
FIG. 12 is a left-front perspective view of the joint gutter shown in FIG. 7.

The collection channels 22 may span a number of intermediate vertical joints where receptacle boxes are not located. For example, in FIG. 9, a vertical joint 79 between adjacent panels 13 is not located at the end of collection channel 22. Leaks may occur in joint 79, yet there is no receptacle box to intercept and redirect the moisture outside the building. For that purpose, a joint gutter 81 is provided. As shown in FIG. 12, joint gutter 81 includes opposing side walls 82, a front wall 83, a rear wall 84, and a discharge outlet 86. Joint gutter 81 also has an open top 87 for interception and collection of water and condensation within joint 79 above the gutter. To install gutter 81, a trail of silicone sealant 88 is applied to side walls 82, and the gutter is inserted into the joint, from the outside of the building. The gutter is located within the joint, so that discharge outlet 86 is roughly centered over center channel 31 of collection channel 22. After the silicone has cured, the upper section 62 and lower section 63 of backer rod are installed, and the exterior waterproofing seal is formed within the joint as described previously.

Figure 6:
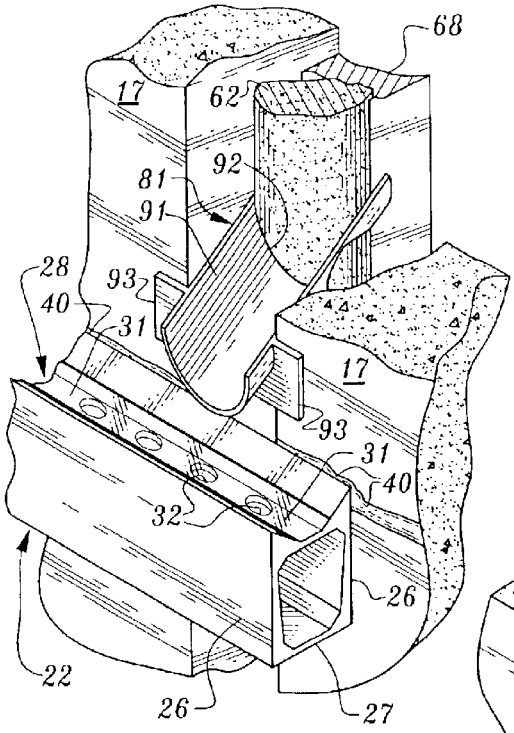
FIG. 6 is a fragmentary, left-front perspective view of a collection channel and a joint gutter, taken from the rear side of two panels.

An alternative embodiment, in the form of a joint gutter 89, is shown in FIG. 6. This embodiment is particularly useful for relatively narrow joints, where gutter 81 cannot fit. Joint gutter 89 is preferably made from a flexible silicone elastomeric compound, so it can be formed and successfully fitted into narrow confines. Gutter 89 includes a U-shaped trough 91, having a circular cutout 92 at its upper end. Cutout 92 is sized and configured to accommodate backer rod 62. Opposing lateral flanges 93 are provided to fit flush against rear wall 17. Silicone sealant is applied to the rear faces of flanges 93, and the trough 91 is squeezed to slide into the panel joint. Upon release, the resilient trough expands to span the joint, and the sealant on the flanges bonds with the rear wall 17. Additional sealant is then applied around the side edges of the trough so that all water and condensation will be directed into the collection channel 22.

Figure 9:
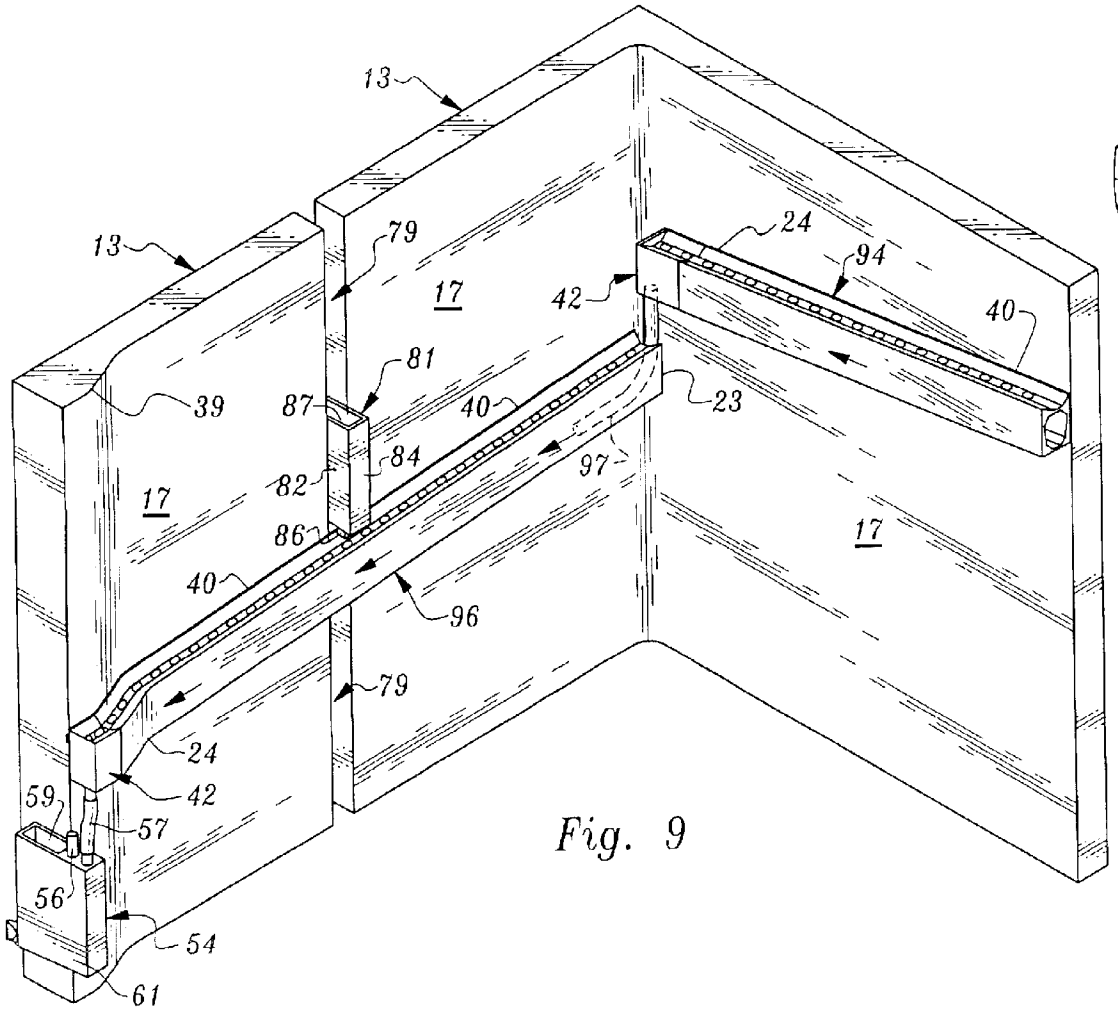
FIG. 9 is a rear perspective view of corner panels, showing an upper collection channel on one panel interconnected to a lower collection channel on an adjacent pair of panels, including a joint gutter therebetween.

Yet another feature of the system 11 is shown in FIG. 9, in which a corner of the building is represented. Both upper collection channel 94 and lower collection channel 96 are constructed in identical fashion as the previously described collection channel 22. What is different in this arrangement is the vertical relationship between channel 94 and channel 96. The lower end 24 of collection channel 94 is above the upper end 23 of collection channel 96. Both channels 94 and 96 are inclined for positive drainage of water. An end cap 42 is provided at the lower end 24 of channel 94. A piece of tubing 97, formed as an elbow, hydraulically interconnects the drain spout under end cap 42 with the interior of the upper end 23 of collection channel 96. In this manner, water collected from the one wall and directed into channel 94 is transferred into channel 96, to join the water collected from the other wall and from any intervening vertical joints, and thereafter discharged to the exterior of the building.

Figure 15:
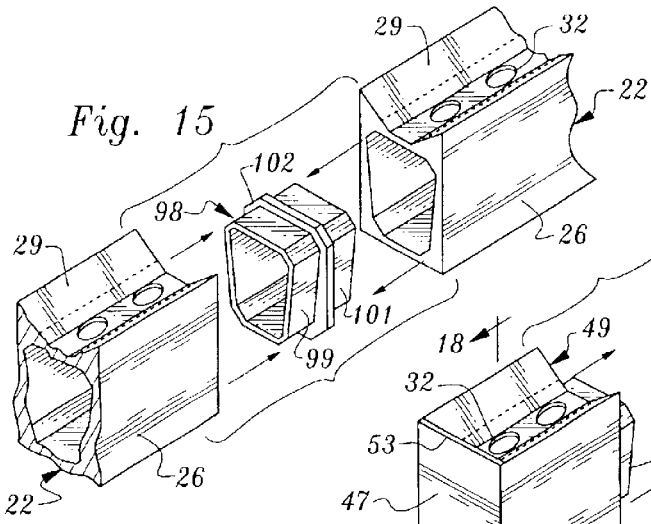
FIG. 15 is a left-front, exploded perspective view of a pair of collection channels with a connection coupler therebetween.

Lastly, for those circumstances where successive lengths of collection channel 22 need to be interconnected, or where repairs of damaged sections of collection channels need to be made, a connection coupler 98 is provided. As shown in FIG. 15, connection coupler 98 includes a first connector section 99, a second connector section 101, and a flange 102 therebetween. Connector sections 99 and 101 are sized and configured to fit snugly within respective open ends of collector channels 22, so that each end of the collector channel abuts flange 102. A film of silicone sealant may also be applied around the connector sections to provide a more positive seal and bond between the components.

It will be appreciated, then, that I have disclosed herein a secondary moisture draining system for use with mid and high rise buildings that have compromised primary passive water barrier systems, or which have developed rear wall panel condensation. The secondary moisture draining system is easy to install, effective in intercepting and collecting water and moisture both from rear walls of panels and from panel joints, and directing and discharging such water and moisture outside the building to minimize damage and to inhibit the growth of mold.

What is claimed is:

1. A secondary moisture drainage system for use with buildings utilizing pre-manufactured exterior panels, comprising:

an elongated collection channel sloping between an upper end and a lower end, said collection channel including opposing side walls, a bottom floor spanning said side walls, and a top cover at least partially open for receipt of moisture, said top cover comprised of a trough having inclined side walls converging inwardly and downwardly toward a bottom channel, and in which a plurality of apertures is provided in said bottom channel; and, a receptacle box, having an upper, rear portion in hydraulic communication with said lower end of said collection channel, and having a front portion with a lower discharge outlet, so that moisture received by said collection channel is directed into said receptacle box and released through said discharge outlet.

2. A secondary moisture drainage system for use with buildings utilizing pre-manufactured exterior panels, comprising:

an elongated collection channel sloping between an upper end and a lower end, said collection channel including opposing side walls, a bottom floor spanning said side walls, and a top cover at least partially open for receipt of moisture;

a receptacle box, having an upper, rear portion in hydraulic communication with said lower end of said collection channel, and having a front portion with a lower discharge outlet, so that moisture received by said collection channel is directed into said receptacle box and released through said discharge outlet; and, an end cap, said end cap having side walls, and a bottom floor spanning said side walls, said end cap further including a connection flange on one end and an end wall on the other end, said connection flange being sized and configured to compression fit within said lower end of said collection channel, and said end wall sealing off said other end, said end cap further having a drain in said bottom floor adapted for hydraulic connection with said rear portion of said receptacle box.

3. A secondary moisture drainage system for use with buildings utilizing pre-manufactured exterior panels, comprising:

an elongated collection channel sloping between an upper end and a lower end, said collection channel including opposing side walls in which an outer side of one of said side walls is provided with adhesive, a bottom floor spanning said side walls, and a top cover at least partially open for receipt of moisture; and, a receptacle box, having an upper, rear portion in hydraulic communication with said lower end of said collection channel, and having a front portion with a lower discharge outlet, so that moisture received by said collection channel is directed into said receptacle box and released through said discharge outlet.

4. A secondary moisture drainage system for use with buildings utilizing pre-manufactured exterior panels, comprising:

an exterior panel having an outer front wall, an inner rear wall, and vertical edge; an elongated collection channel mounted on said rear wall of said exterior panel, said collection channel sloping between an upper end and a lower end and including opposing side walls, a bottom floor spanning said side walls, and a top cover at least partially open for receipt of moisture;

a receptacle box mounted on said vertical edge of said panel, said receptacle box having an upper, rear portion in hydraulic communication with said lower end of said collection channel, and having a front portion with a lower discharge outlet extending to said front wall of said panel, so that moisture received by said collection channel is directed into said receptacle box and released through said discharge outlet.

5. A secondary moisture drainage system for use with buildings employing pre-manufactured exterior panels, comprising:

first and second elongated collection channels, said first collection channel being mounted on a rear wall of a first panel, and said second collection channel being mounted on a rear wall of a second panel, said first and second panels having adjacent vertical edges defining a vertical joint therebetween, each of said collection channels sloping from an upper end to a lower end, said lower ends of said collection channels being proximate and said upper ends of said collection channels being remote, said collection channel including opposing side walls, a bottom floor spanning said side walls, and a top cover at least partially open for receipt of moisture; and, a receptacle box mounted within said vertical joint, said receptacle box having a rear portion in hydraulic communication with said lower ends of said collection channels, and having a front portion with a lower discharge outlet.

6. A drainage system as in claim 1 in which said apertures are oval in configuration.

7. A drainage system as in claim 4 including an end cap, said end cap having side walls, and a bottom floor spanning said side walls, said end cap further including a connection flange on one end and an end wall on the other end, said connection flange being sized and configured to compression fit within said lower end of said collection channel, and said end wall sealing off said other end, said end cap further having a drain in said bottom floor adapted for hydraulic connection with said rear portion of said receptacle box.

8. A drainage system as in claim 7 in which said drain includes a spout extending downwardly therefrom, and further including a drain tube extending between said spout and said rear portion of said receptacle box.

9. A drainage system as in claim 7 in which said end cap further includes a top cover, said top cover comprising a trough having inclined side walls converging inwardly and downwardly toward a bottom channel, and in which a plurality of apertures is provided in said bottom channel.

10. A drainage system as in claim 4 in which an outer side of one of said side walls is provided with adhesive.

11. A drainage system as in claim 4 in which an outer side of one of said side walls is provided with a flange.

12. A drainage system as in claim 11 in which said flange is dovetail in configuration.

13. A drainage system as in claim 4 including a plurality of said collection channels, and further including means for interconnecting adjacent ends of said channels so they are maintained in end to end relation and hydraulically sealed therebetween.

14. A drainage system as in claim 13 in which said interconnecting means comprises a connection coupler, said connection coupler including a first connector section, a second connector section, and a flange therebetween, said first and second connector sections being sized and configured to fit snugly within an open end of a respective collector channel, so that each of said open ends abuts said flange.

15. A drainage system as in claim 4, including a joint gutter, said joint gutter having opposing side walls, a front wall, a rear wall, a discharge outlet, and an open top, said joint gutter being positioned above said collection channel at a location intermediate said upper end and said lower end, with said discharge outlet over said top cover of said collection channel.

16. A drainage system as in claim 4, including a joint gutter, said joint gutter having a U-shaped trough with a circular cutout at an upper end and opposing lateral flanges at a lower end, said joint gutter being made from a flexible silicone elastomeric material.

17. A drainage system as in claim 4 in which said discharge outlet is provided with a one-way valve.

18. A drainage system as in claim 17 in which said one-way valve is a pinch valve.

19. A drainage system as in claim 17 in which said one-way valve is a flap valve.

20. A drainage system as in claim 4 in which said collection channel and said receptacle box are made from a flexible, flame retardant elastomeric silicone.

21. A drainage system as in claim 20 in which said silicone includes retardants to inhibit mold growth.

22. A drainage system as in claim 4 further including a removable strip having a silicone compatible adhesive on its underside, said strip being installed with its underside over a portion of said top cover for protection of openings therein.

23. A drainage system as in claim 5 in which a first section of a backer rod is located within said vertical joint, extending upwardly from said receptacle box, and in which a second section of a backer rod is located within said vertical joint, extending downwardly from said receptacle box, said first section and said second section and a front wall of said receptacle box providing a backing for sealant which is injected into said vertical joint and which spans said vertical edges, to form a weatherproofing seal.

24. A drainage system as in claim 23 in which said discharge outlet of said receptacle box passes through said weatherproofing seal.

25. A secondary moisture drainage system for use with buildings employing pre-manufactured exterior panels, comprising:

[a.] an upper collection channel and a lower collection channel mounted on a rear inner wall of an exterior panel, each of said collection channels sloping from a respective upper end to a respective lower end, said lower end of said upper collection channel being adjacent and above said upper end of said lower collection channel and in hydraulic communication therewith, each of said collection channels including opposing side walls, a bottom floor spanning said side walls, and a top cover at least partially open for receipt of moisture; and,

[b.] a receptacle box mounted on a vertical edge of an exterior panel, having a rear portion in hydraulic communication with said lower end of said lower collection channel, and having a front portion with a lower discharge outlet extending to a front outer wall of an exterior panel, so that moisture received by said collection channels is directed into said receptacle box and released through said discharge outlet.

26. A drainage system as in claim 25 in which said lower end of said upper collection channel includes an end cap, said end cap having side walls, and a bottom floor spanning said side walls, said end cap further including a connection flange on one end and an end wall on the other end, said connection flange being sized and configured to compression fit within said lower end of said upper collection channel, and said end wall sealing off said other end, said end cap further having a drain in said bottom floor adapted for hydraulic connection with said upper end of said lower collection channel.

27. A drainage system as in claim 26 in which said drain includes a spout extending downwardly therefrom, and further including a tube extending between said spout and said upper end of said lower collection channel.

28. A drainage system as in claim 26 in which said end cap further includes a top cover, said top cover comprising a trough having inclined side walls converging inwardly and downwardly toward a bottom channel, and in which a plurality of apertures is provided in said bottom channel.

29. A method of installing a secondary moisture drainage system to a pre-manufactured exterior panel, comprising the steps of:

[a.] providing a pre-manufactured exterior panel, having a vertical edge, an inner rear wall, and an outer front wall;

[b.] securing a collection channel to said rear wall of said panel, so that an upper end of said collection channel is sloping to and remote from said vertical edge and a lower end of said collection channel is proximate said vertical edge;

[c.] securing a receptacle box along said vertical edge, with a front discharge outlet adjacent said front wall and a rear portion adjacent said rear wall; and,

[d.] hydraulically interconnecting an upper rear portion of said receptacle box with said lower end of said collection channel.

30. A method as in claim 29, in which said step of securing said collection channel is carried out using silicone sealant.

31. A method as in claim 29, in which said step of securing said collection channel is carried out using a mortar slurry applied to said rear wall and encasing a flange on said collection channel.

32. A method as in claim 29, further including the steps of providing a second panel having a second vertical edge in spaced relation from said vertical edge of said panel, defining a vertical joint therebetween, installing an upper section of backer rod above said receptacle box and installing a lower section of backer rod below said receptacle box within said vertical joint, and injecting silicone sealant into said vertical joint from said front wall of said panel against said upper and lower sections and against said front portion of said receptacle box.

* * * * *